United States Patent [19]

Weigl et al.

[11] Patent Number: 5,007,645

[45] Date of Patent: Apr. 16, 1991

[54] GOLF PRACTICE DEVICE

[76] Inventors: William Weigl, 1805 Conwood Dr.; George Churley, 174 Merry Robin Rd., both of Troy, Ohio 45373

[21] Appl. No.: 399,994

[22] Filed: Aug. 29, 1989

[51] Int. Cl.[5] ..... A63B 69/00

[52] U.S. Cl. ..... 273/181 F; 273/26 A; 273/29 A; 273/407; 273/410

[58] Field of Search ..... 273/26 A, 29 A, 181 R, 273/181 A, 181 F, 181 J, 181 K, 184 R, 185 R, 407, 410; 160/89, 113, 119

[56] References Cited

U.S. PATENT DOCUMENTS

| | | | |
|---|---|---|---|
| 4,153,246 | 5/1979 | Byrne | 273/26 A |
| 4,183,524 | 1/1980 | Kifferstein | 273/29 A |
| 4,653,566 | 3/1987 | Miale | 160/113 |

*Primary Examiner*—Edward M. Coven

*Assistant Examiner*—Raleigh W. Chiu

[57] ABSTRACT

Golf practice device such as a net or the like for use from within or outside a garage, the net being mounted internally of the garage door adjacent its upper edge in both a storage condition and a use condition and being rolled up on a bar or rod and supported out of the way on end brackets on the inside of the door in said storage condition. The mounting and brackets are designed so as to enable the door to be raised and lowered as needed when the device is in storage condition, and to further enable the door to be raised while the net is in its use condition, without obstruction of door movement and without risk of damage to the net or the door. The brackets themselves are also adapted to be mounted on either a vertical wall or suspended from a horizontal ceiling, in either of which locations, the brackets can serve for both storage and use of the net.

12 Claims, 2 Drawing Sheets

GOLF PRACTICE DEVICE

The invention relates generally to a ball-striking net for hitting light-weight practice golf balls by an individual from within or outside a garage. In particular, it relates to such a practice device which can, if desired, be permanently supported internally on a garage door in both storage and use conditions.

BACKGROUND OF THE INVENTION

Consideration has been given in the past to providing golf practice nets for garage use. Examples are found in U.S. Pat. Nos. 4,183,524 and 4,153,246. The '524 system illustrates a complex frame structure mounted on the inside of the door. It attaches to specially-constructed floor brackets and is designed for use from a player position outside the garage with the door open. As such, it is not suitable for use in inclement weather, particularly during winter in colder climes, at a time when a golfer may wish to "groove" his or her swing by periodic practice sessions and striking of practice balls for the "feel" of making ball contact. Not only is the '524 structure complex, it is also costly, consumes time to set up and take down, and is limited by its design solely for use with a one-piece door, as distinguished from a door consisting of four or five horizontal, articulated door panels. In contrast, our invention can be mounted on any kind of garage door, and, in the embodiment illustrated, can be used with the door open or closed, and is preferably designed for the latter.

The '246 patent, while considerably simpler and capable of being readied for practice and returned to the storage state without much bother, has other infirmities. The manner in which the net is mounted subjects it to potential damage in the event the garage door is accidentally raised or lowered while the net is in its use condition. The door in the '246 patent cannot be intentionally raised or lowered without first returning the net to its storage condition, for example, in the event a practice session is interrupted, or in the case of a double-width garage with a single wide door, a car is to be let in or out of the side opposite the practice side.

BRIEF DESCRIPTION OF THE INVENTION

A primary feature of our invention is in its being supported on and movable with a garage door in both storage and use conditions, in the ease of readying the net for practice as well as the ease of returning it to the storage condition, in its relatively simple and inexpensive construction and in the safety to the net and door in the event of either accidental or intentional movement of the door from one condition to the other, independently of whether the net was in its storage or use condition at the time of door operation. Another feature of our invention is in the supporting brackets themselves, which can support a pair of bars movable with a garage door or which can also be permanently mounted on either a vertical wall or be suspended from a horizontal ceiling without modification.

Our device provides the capability of driving practice balls into the net either from inside the garage during bad weather or from outside or inside in good weather. This use capability feature, while present in the system illustrated in the aforementioned U.S. Pat. No. 4,153,246, is without the latter's disadvantages, i.e., the requirement that the net be placed in its storage condition each time the door is to be raised or lowered. In the '246 patent the door cannot be raised when the net is being used for practice in the lowered position, nor can the door be lowered when the net is being used for practice in the raised position. Further, the device of our invention enables a portion of the net to serve as a ball-trapping apron as balls fall from the net to the floor, this being further facilitated by supporting the lowered end of the net off the floor by a bar supported at its ends by disk means.

A further advantage of the preferred embodiment is to enable ease of removal of the device from the garage door, ceiling or wall for installation and use in one's yard for driving real golf balls thereagainst.

OBJECTS OF THE INVENTION

A principal object of the invention is to provide a relatively low cost, simple to operate, garage-door-type golf practice net which eliminates risk of damage to the equipment in the event of inadvertent door operation while the net is in practicing condition, and which avoids the necessity to return the net to its storage condition each time the door must be raised or lowered. An example of the latter is where one person is practicing inside the garage and another needs to raise the door for removing a lawn mower or vehicle from or return it to the garage.

Another object is to provide for a simple mounting of the net to enable, if desired, easy removal of the net for yard usage with regular golf balls during summer.

Still another object, in the case where the height of one's garage allows use of shorter golf irons inside the garage but restricts use of longer wood clubs, is to enable practice with woods from outside the garage when weather permits, without altering the manner in which the net is stored on the door.

Most importantly for commercial and manufacturing reasons, it is an object to provide bracket means which are of a construction enabling ease of mounting on a variety of different kinds of doors, whether the door is paneled or of one piece construction. The bracket design also takes into consideration whether the door has single or double garage door width, and, in the case of a double-width door, whether or not the door has a centrally-mounted automatic garage door opener. The preferred bracket design allows their use on either a vertical wall or a horizontal ceiling, either of which may be indoors or outdoors. For example, the ceiling may be the underside of a roof overhang.

These and other advantages will be apparent from the following description, in which reference is made to the accompanying drawings.

IN THE DRAWINGS

DESCRIPTION OF THE PREFERRED EMBODIMENT

Figure 1:
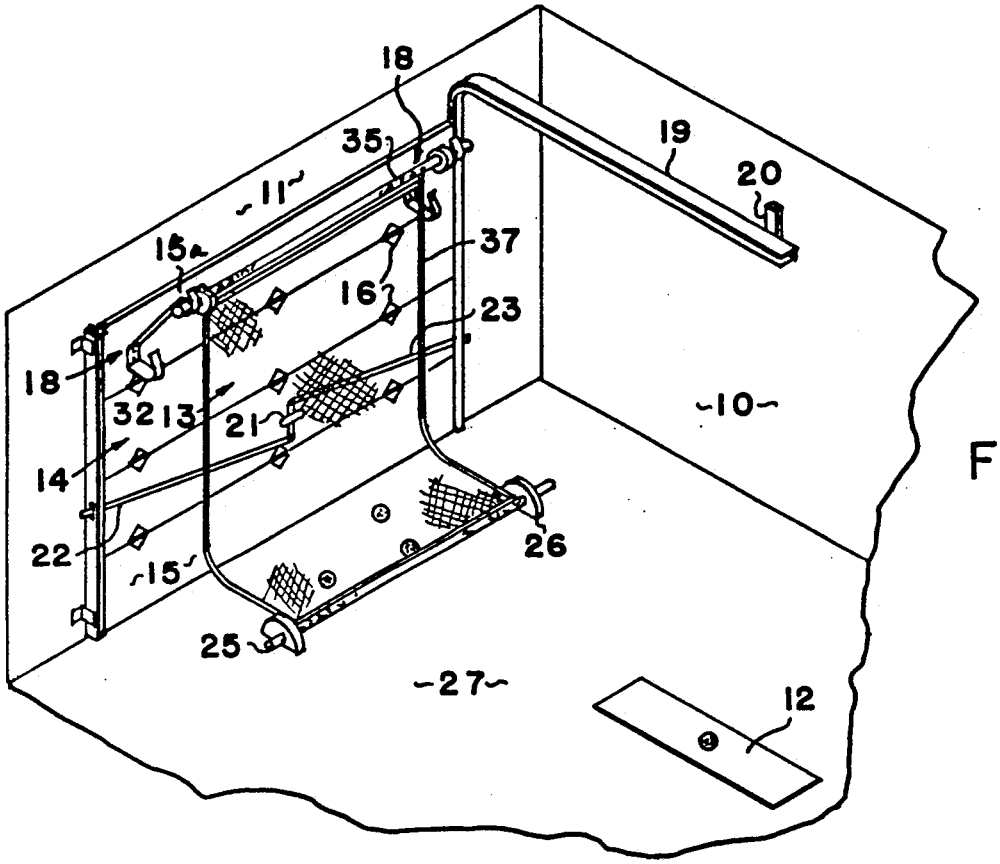
FIG. 1 is a simplified pictorial view from inside a garage having a single door of articulated panel construction, illustrating the net in lowered, practicing condition.

While the invention may be used on either single or double garage doors, articulated door panels guided in tracks around a curve or a single piece door, and doors which are motorized or manually-operated between their up and down conditions, the preferred embodiment of the invention is simply described in FIG. 1 in connection with a manually-raised single width door of articulated panels. When mounted on a double-width door, it may be mounted on either the left or right side, or even centrally, if desired and if unobstructed.

Walls 10 and 11 are interior walls of the garage having a standard ceiling height sufficient to allow an average-height practicing golfer at the position adjacent a mat 12 to swing golf clubs from within the garage itself without obstruction. The mat is preferably elongated to guide the player in swinging straight toward the target. In the event the garage ceiling is inordinately low, the system is of limited value for internal, winter use. It could then be used only for hitting from the outside into the garage with the door fully raised and the net 13 suspended as illustrated in dotted lines at the right in FIG. 2.

The garage door 14 has hinged panels 15 extending across the full width of the door opening door. Hinges 16 interconnect the panels 15 at several locations, and a plurality of crossbars extend the length of one or more of the panels for strengthening purposes and prevention of panels bowing. Only one such cross bar 17 is shown at the upper edge of a top panel 15*a*, since in the preferred embodiment it is the only crossbar which affects the design of the pair of brackets 18 which form the basic supporting structure for the net 13.

The panels 15 carry the usual cantilevered rollers extending on axles outwardly from the ends of the panels. The rollers operate in channels formed in guide tracks 19 which are supported along the vertical inner edge of the door opening and parallel to the ceiling as shown in FIG. 1. At their innermost upper ends, they are typically supported by brackets 20 suspended from overhead jousts or other structure forming a part of the ceiling or roof of the garage. The horizontal and vertical portions of each guide track 19 connect at a curve to allow for articulation of the hinged panels when moving between their vertical and horizontal positions. Since the type of door 14 forms no part of the invention, the articulated panels are shown merely for illustrative purposes, it being understood that the door may also be of single piece construction.

In the background environment shown in FIG. 1, there is a handle 21 which operates a crank to move bars 22 and 23 into and out of latching slots in the guide tracks 19. The door 14 is shown in the downward or closed position. For raising the door, the handle is turned manually to operate the crank to pull the bars 22 and 23 inwardly and out of the slots in the tracks. This enables the handle 21 to then be used to lift the door. Such a door may be assisted by springs to enable guiding it into the horizontal portions of the guide tracks 19. In the event the door 14 is one which can be raised automatically from a wall switch within the garage or from a garage door opener ordinarily carried within an automobile, there would normally be a motor (not shown) suspended approximately midway between the brackets 20 and provided with a screw extending horizontally toward the front wall 11. The panel 15*a* has a bracket 24 shown in dotted lines in FIG. 3, which would be connected to the panel 15*a* and to a half-nut meshing with a lead screw (not shown) driven by such motor. These elements have not been illustrated because they are common and do not constitute any part of our claimed subject matter. Rotation of the screw causes the nut to move the bracket 24 to raise and lower the door in response to motor operation. Again, while our invention is useful with either motorized or manually-operated doors, each presents its own type of installation problem. For example, if the garage has a double-width door and is one which stores two vehicles, and the net is on one side or the other and is in use for practice, a person arriving in a car can operate the motor to raise the door in order to enter the garage while someone is practicing with the net in the down position as shown in FIG. 1. This may result in a temporary delay in the practice session, since the door may be fully raised to permit the car to enter the garage alongside the practice area. Or, if desired, upon discovering that someone is practicing, the person raising the door may decide to again lower it and leave the vehicle outdoors.

Part of the reason for illustrating a manual door opening system in FIG. 1 is that the handle 21 is typically on one of the lower panels of the door 14 or the lower section of a single piece door. When the net is rolled up in the storage condition of FIGS. 3 and 4 as will be described, freedom of access to handle 21 for raising and lowering the door is necessary. For this reason, we prefer that the entire storage area of the net be at the upper portion of the door 14, although it can extend from top to bottom if desired, without affecting operability of the door. This also provides that the net is out of the way when a car is parked within the garage. If stored lower than shown, the net may not allow much space between the rear bumper and the door 14 itself, depending on the depth of the garage and length of the car. Such space is often needed for standing purposes either to operate the door or to get access to the trunk of the vehicle.

Figure 2:
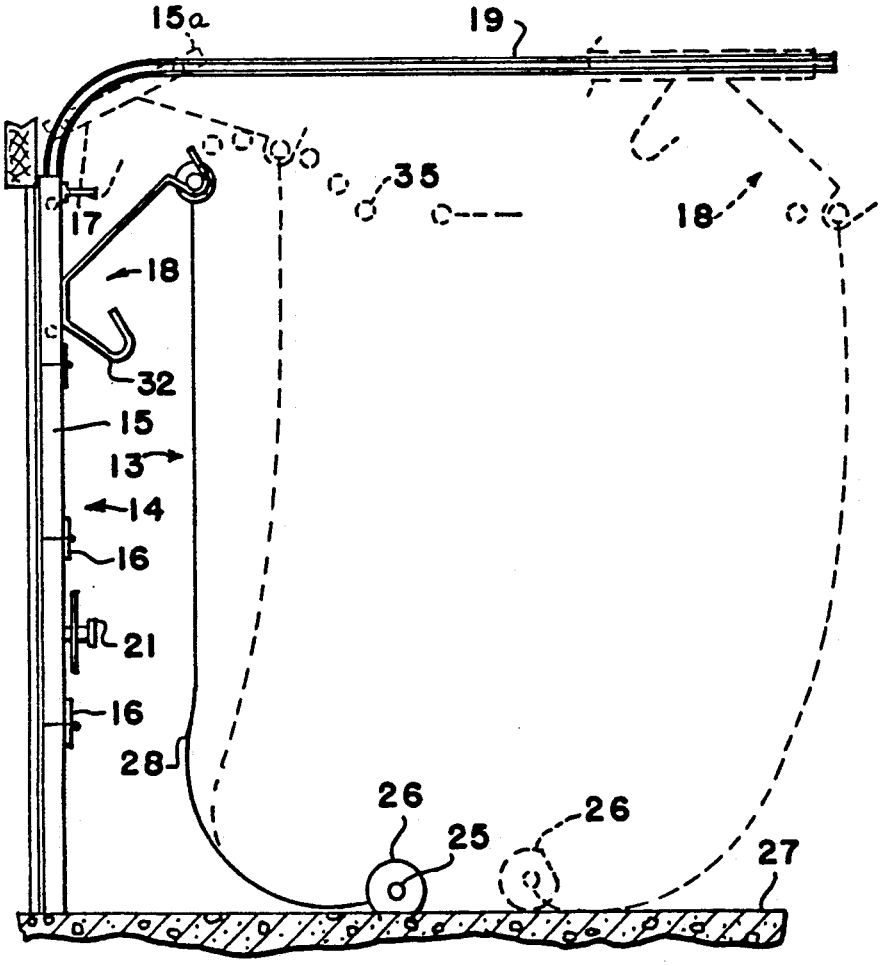
FIG. 2 is a side elevational view showing the net in practice or use condition, illustrating in dotted lines the various positions of the net and door in the event the door is raised while the net is in its use condition. The final or fully-raised position of the door is also the net position for practice when hitting from outside into the garage.

FIG. 2 illustrates the net 13 somewhat schematically in practice condition with the door 14 in the closed or down position. The net is preferably suspended at least 8" away from the door and is weighted by means of a bar 25 having disks 26. This enables the practicer to essentially anchor the lower edge of the net sufficiently to maintain the net against movement when contacted by light weight plastic practice balls driven from the mat 12. The system is not intended for real golf ball practice when used indoors. Ideally, the net is draped to have a curved portion 28 to allow practice balls to fall on the curved portion 28 and roll toward and be arrested by the bar 25. The bar 25 traps balls at the bottom of the net between the bar 25 and the door 14. Occasionally, a ball falling from the net may land directly on the floor and bounce over the bar 25 but that is of little or no consequence. The disks 26 have one or more flat sides to prevent their rolling during practice.

Assume now that the door is in the practice condition shown in full lines in FIG. 2 and someone approaching the garage operates an automatic door opener to commence raising the door 14. The top panel 15*a* of the door will move from its full-line position to a first dotted-line position, commence around the curved tracks and then move all the way to the right as also shown in dotted lines. During this time, the disks 26 may roll and/or be dragged slightly from the solid-line left position to the dotted-line right position, and the net 13 will drape from its full-line position shown at the left of FIG. 2 through a series of positions until it reaches the right-most dotted-line position. As will be noted, no injury to the net can occur while the door is being raised. When it is returned to the closed position, the practicer may have to return the bar 25 supported by the disks 26 to its original position for practice, but that is all. Play can resume after only a slight inconvenience.

For warm weather practice, the golfer may hit the plastic balls from outside into the garage with the door in the raised position and the net at the right-most position as shown in FIG. 2. The disks 26 and the bar 25, of course, should be located for best results in letting practice balls drop from the net, run down the curved portion and be trapped by the bar 25. Preferably, the disks 26 are about 4" in diameter, so as to have the bar 25 nearly 2" off the level of the floor 27, for the baLL-trapping function.

Figure 3:
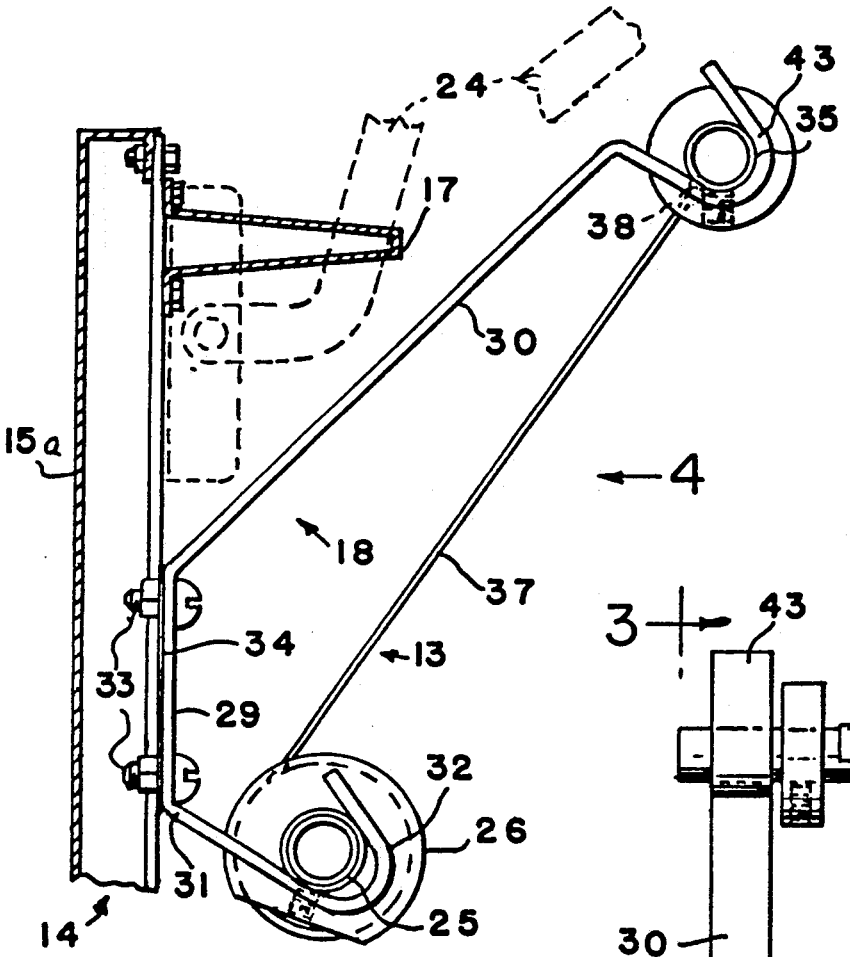
FIG. 3 is a view of the net and brackets in net storage condition on a paneled door, taken essentially along lines 3—3 of FIG. 4.
Figure 4:
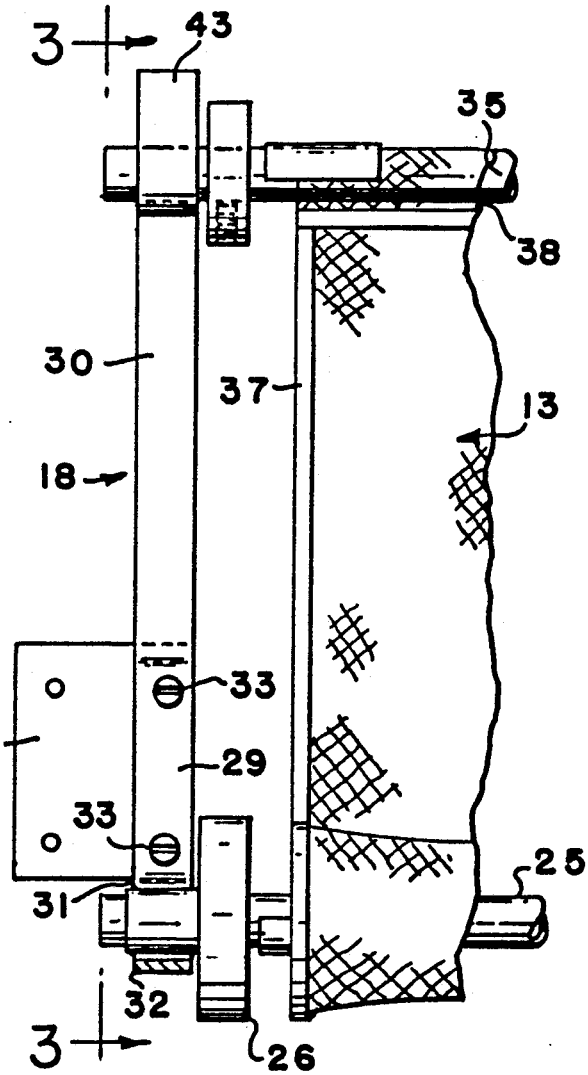
FIG. 4 illustrates a net-supporting bracket carrying one end of a rolled net, and is taken viewing the device from the direction of arrow 4 in FIG. 3, parts being broken away.

Structural details of key elements of our design are best illustrated by cross referring between FIGS. 3 and 4. The brackets 18 are of single-piece construction in their preferred form. They may also be made of two pieces with the upper portions that support the top of the net being mounted on the top surface of the door and the lower portions which support the rolled-up net being fastened to the upper door panel 15*a*. For simplicity and convenience, we choose to make each of the brackets 18 identical and of one piece construction, each bracket having a mounting base 29, an upwardly and inwardly extending net-supporting portion or arm 30 and a downwardly and inwardly roll-supporting portion or arm 31. At the extended ends of the arms 31, there are formed U-shaped portions 32 which are adapted to receive the ends of the bar 25 when the net is in storage condition. It will be noted that the U-shaped portions 32 are arranged to have the open part of the "U" facing upwardly to some extent in both the vertical and horizontal positions of the door. The inner surface of each U-shaped portion 32 is preferably slightly smaller than the outer diameter of the bar 25. The disks 26 may be used to turn the bar 25 to wind up the net on the bar 25, if desired. It may be also practical to simply add a crank mechanism to one end of the bar 25 to wind up the net. Ordinarily, however, it is extremely simple, with the net in the practice position shown in FIG. 2, to take the bar in one's hands and roll the bar in a winding motion either clockwise or counterclockwise, whichever is most convenient for the individual. This can be done until the bar 25 is perhaps chest high at which time the ends of the bar 25 can be placed in the U-shaped portions 32 of the brackets 18. If desired, and if the net would tend to loosen from door movement vibrations, a piece of somewhat frictional, material such as friction tape can be placed on at least one end of the bar 25. The material in its U-shaped portion can then provide slight friction and prevent the bar 25 from turning freely when the system is moved periodically while in the storage condition.

The design of the brackets 18 accommodates different types of doors, whether made of wood or sheet metal, solid or hollow, and with or without insulation. If the door is made of wood or an artificial wood product, the bases of the brackets 18 can be fastened thereto with self-tapping screws. If desired, and if the door construction is hollow and permits use of toggle bolts, a more secure anchor can be achieved. We have found that only two screws or bolts are necessary for each bracket 18. In the case of metal doors, the panels are typically provided with galvanized steel braces at their ends, through which holes can be drilled and screws and bolts 33 used for fastening purposes. In the case of a double width door, interference with the bracket 24 which automatically raises and lowers the door in response to operation of the motor has to be avoided. To circumvent this problem, we can provide a plate 34 to which the left bracket 18 shown in FIG. 4 is bolted to allow the left bracket 18 to be offset inwardly of the door-raising bracket 24. The holes at the left of plate 34 in FIG. 4 are then used to attach the plate to the door directly below the bracket 24. As mentioned earlier, a typical door has a crossbar 17 extending across the top panel 15*a* as shown in FIG. 3. The angle selected for the arms 30 which support the upper edge of the net is designed to clear the inner edge of the crossbar 17. The angle selected for the arms 31 avoids interference between the brackets 18 and the next-lower panel as the panels pass around the curve in the guide tracks 19.

A bar 35 supports the upper end of the net 13. At their extended ends, the arms 30 are preferably provided with U-shaped portions 43 similar to portions 32. The bars 25 and 35 are preferably one piece and may be a material such as thin-walled electrical conduit, but obviously if the unit is to be capable of packaging for ease of shipment, a bar of seven or eight foot length presents a problem. To accommodate shipping, bars 35 and 25 may be shorter lengths made of telescoping or swaged construction with one or two joints each, but constructed to form essentially rigid bars. Any of several different constructions can be used for this purpose.

Ideally, the net 13 should have a tape or edging 37 sewn at each of its sides and a pocket or sleeve 38 at each the top and bottom. The bars 25 and 35 pass through the pockets 38. The pockets through which the bars pass are fastened to the bars by adhesive taping or some other fastening means to locate the net midway between the brackets 18. Each of the disks 26 can be fastened to the bar 25 by means of screws 41. When the disks 26 are first assembled to the bar 25, they should be placed on the flat floor so that the flats of the wheels 26 align to provide solid contact with the floor. Even plastic balls are capable of moving the net if it is not restrained.

We have thus avoided the complexity of the prior art systems by enabling practicing one's golf swing inside or outside a garage while driving light weight practice balls into a net, and do so with a simple, inexpensive structure which takes very little time to move between the storage and practice conditions, is out of the way when stored and, most importantly, avoids risk of damage to the net whenever the door is intentionally or accidentally raised or lowered while in the practice condition. The system is useful for practice by adults or children, and helps "groove" one's swing and builds a golfer's muscle memory. It can also serve for "warm-up" purposes during good weather just prior to playing a round of golf.

The brackets described herein can be used independently of a garage door, for example, on an inside or outside wall, under a roof overhang in the position they occupy when the door is horizontal, and even on a pair of trees spaced the correct distance. An advantage of using the brackets design where two U-shaped portions are utilized is that during the summer, the net can be left under the overhang and used outdoors on a regular basis.

Various modifications may be made without departing from the spirit and scope of our invention.

Having described our invention, we claim:

1. A golf practice device for use within a garage and for mounting on the interior of a garage door in both a use condition and a storage condition while enabling raising and lowering of said door whether said device is in either of said use or storage conditions, said device comprising a ball-striking net against which light-weight golf balls can be driven from a golfer's practice position within said garage, said net having a height generally at least as high as said door and a horizontal width greater than half the door height, bracket means mounted on the interior upper half of the door for suspending the net at its upper edge inwardly of said door when in use condition whereby to arrest balls striking the net, and, when so suspended, being spaced inwardly from the door, said bracket means also supporting the net in storage condition on the inside of the door, and, means for maintaining the bottom of the net inwardly of and away from the door when the net is in its use condition.

2. The device according to claim 1 wherein the net is greater in length than the height of said door and is capable of extending inwardly of the garage on the floor a short distance to capture fallen balls, and wherein said maintaining means consists of a bar extending the full width of the net along the bottom thereof and being fastened to said net, said bar serving to wind the net thereon when the net is in storage condition.

3. The device of claim 2 wherein said bar is round, and wherein said bracket means consists of a pair of brackets spaced horizontally a distance less than the length of said bar and each bracket has at least one essentially U-shaped portion with the open part of the U facing upwardly while the door is in either its raised or lowered condition for supporting said bar when in storage condition.

4. The device of claim 3 wherein means is provided on the bar for maintaining it against axial shifting when the net and bar are in their storage conditions.

5. The device of claim 4 wherein a disk with at least one flat portion is mounted on each end of said bar for maintaining the bar a distance above the garage floor when the net is in use condition, to trap balls in said net as they fall therefrom.

6. The device according to claim 5 wherein at least one of said disks may be used to turn said bar to wind or unwind the net when the bar is supported in said U-shaped portions of said brackets.

7. The device according to claim 1 wherein the door comprises a plurality of articulated, hinged panels and wherein the net-supporting bracket means is mounted solely on the top panel of said door.

8. The device of claim 1 wherein the net is also capable of being used for hitting practice with light-weight balls from the exterior of said garage, said net being suspended vertically downwardly from the bracket means when the door is in its raised, essentially horizontally position.

9. The device according to claim 3 wherein each of said brackets is integral at each end of said gold practice device.

10. In a golf practice device for use within a garage and for mounting on the interior of a garage door in both a use condition and a storage condition while enabling raising and lowering of said door whether said device is in either of said use of storage conditions, a ball-striking net against which lightweight gold balls can be driven from a golfer's practice position either from within or outside said garage said net having a height generally at least as high as said door and a horizontal width greater than half the door height, a pair of spaced-apart brackets mounted on the interior upper half of the door, said brackets having first portions angled inwardly and upwardly and second portions angled inwardly and downwardly relative to the door when the door is in its lowered, closed position, at least one of said portions of each bracket having a reverse U-shaped end with the open part of the U facing upwardly whether the door is in its raised or lowered position, a first horizontal bar fastened to and supporting the upper edge of the net between the first portions of the brackets, and, a second horizontal bar fastened to and supporting the lower edge of the net between the second portions of the brackets, both of said bars having a length greater than the spacing between the brackets and at least said second bar being adapted to have its ends supported and seated in the U-shaped bracket ends, said second bar serving as a weight maintaining the bottom of the net away from the door when the net is in condition for use from inside the garage, and whereby the second bar can be used to roll the lower end of the net thereon for storage by placing the ends of the second bar into the U-shaped bracket ends.

11. In a gold practice device according to claim 10 wherein a disk is mounted on each end of said second bar inwardly of said brackets to maintain the second bar against axial movement when in storage condition, said disks being adapted to rest on the garage floor when the net is in use condition to maintain the second bar above the floor the trapping balls as they fall from the net, and wherein the disks may be turned to rotate the second bar in said U-shaped bracket ends to assist in winding the net around the second bar when returning the net from its use to its storage condition.

12. In a golf practice device according to claim 10 wherein both said first and second portions of said brackets have U-shaped ends, wherein the U-shaped ends at the first portions support said first horizontal bar, and the U-shaped ends at the second portions support said second horizontal bar.

* * * * *